US005413350A

United States Patent [19]

Taylor et al.

[11] Patent Number: 5,413,350

[45] Date of Patent: May 9, 1995

[54] ILLUMINATED GAME BOARD WITH LIGHT DIRECTING TRANSPARENT LENS

[76] Inventors: Thomas E. Taylor, 615 Frankham Rd.; Bruce R. Guymon, P.O. Box 1575; Dorothy I. Taylor, 615 Frankham Rd.; Helen E. Guymon, P.O. Box 1575, all of Grants Pass, Oreg. 97526

[21] Appl. No.: 61,560

[22] Filed: May 17, 1993

[51] Int. Cl.[6] ..... A63F 3/00

[52] U.S. Cl. ..... 273/271; 273/269; 40/546

[58] Field of Search ..... 273/237, 264, 269, 271, 273/293, 149 R; 40/541, 546

[56] References Cited

U.S. PATENT DOCUMENTS 3,561,145 2/1971 Shotwell ..... 40/546
3,802,708 4/1974 Libert ..... 273/136 A
4,794,492 12/1988 Vinther ..... 40/546 X
4,807,884 2/1989 Breeding ..... 273/149 R
5,029,871 7/1991 Wilson, Jr. et al. ..... 273/271

*Primary Examiner*—Vincent Millin
*Assistant Examiner*—William M. Pierce

[57] ABSTRACT

A board game includes a game board having a top wall, having a matrix of rows and columns of spaces of contrasting visual enumerations, wherein a plurality of tokens equal to a like plurality of spaces are provided, with a token afforded each space that is indicated by selection of a card from a deck of cards. The object of the game is to create a plurality of rows, wherein sequential spaces, either horizontally, vertically, or diagonally, are filled by one of said tokens. The game board further includes an illumination housing having a transparent lens for directing light from an illumination source.

4 Claims, 4 Drawing Sheets

ILLUMINATED GAME BOARD WITH LIGHT DIRECTING TRANSPARENT LENS

BACKGROUND OF THE INVENTION

1. Field of the Invention

The field of invention relates to board game apparatus, and more particularly pertains to a new and improved board game apparatus wherein the same is arranged to direct positioning of tokens upon a game board in consistency with selection of cards from a card deck.

2. Description of the Prior Art

Game boards of various types have been utilized throughout the prior art, wherein the instant board game apparatus attempts to overcome deficiencies of the prior art by providing for a board game apparatus to direct play of positioning of tokens in a predetermined array upon a game board in consistency with card members selected from a card deck. Examples of prior art game boards and board games employing card members are indicated in U.S. Pat. Nos. 4,362,302; 4,878,675; and 5,064,200.

SUMMARY OF THE INVENTION

In view of the foregoing disadvantages inherent in the known types of board game apparatus now present in the prior art, the present invention provides a board game apparatus wherein the same includes a game board having a matrix of spaces thereon, wherein a row of spaces are occupied by tokens in cooperation with cards selected from a card deck. As such, the general purpose of the present invention, which will be described subsequently in greater detail, is to provide a new and improved board game apparatus which has all the advantages of the prior art board game apparatus and none of the disadvantages.

To attain this, the present invention provides a board game including a game board having a top wall, having a matrix of rows and columns of spaces of contrasting visual enumerations, wherein a plurality of tokens equal to a like plurality of spaces are provided, with a token afforded each space that is indicated by selection of a card from a deck of cards. The object of the game is to create a plurality of rows, wherein sequential spaces, either horizontally, vertically, or diagonally, are filled by one of said tokens.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved board game apparatus which has all the advantages of the prior art board game apparatus and none of the disadvantages.

It is another object of the present invention to provide a new and improved board game apparatus which may be easily and efficiently manufactured and marketed.

It is a further object of the present invention to provide a new and improved board game apparatus which is of a durable and reliable construction.

An even further object of the present invention is to provide a new and improved board game apparatus which is susceptible of a low cost of manufacture with regard to both materials and labor, and which accordingly is then susceptible of low prices of sale to the consuming public, thereby making such board game apparatus economically available to the buying public.

Still yet another object of the present invention is to provide a new and improved board game apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
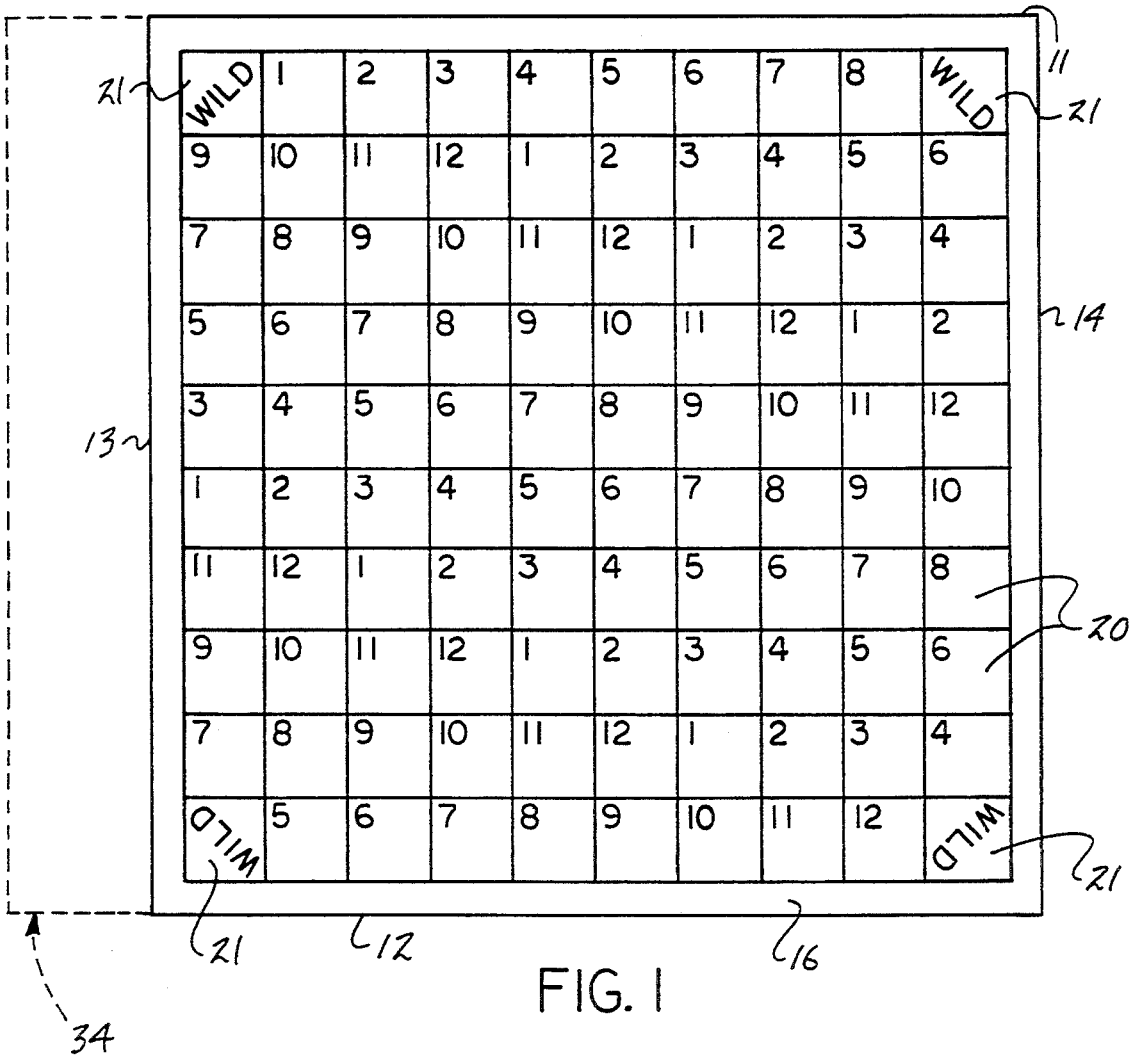
FIG. 1 is an orthographic lop view of the game board of the invention.
Figure 2:
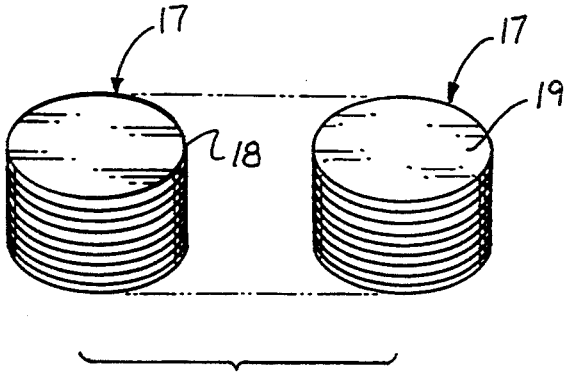
FIG. 2 is an isometric illustration of the token structure utilized by the invention.
Figure 3:
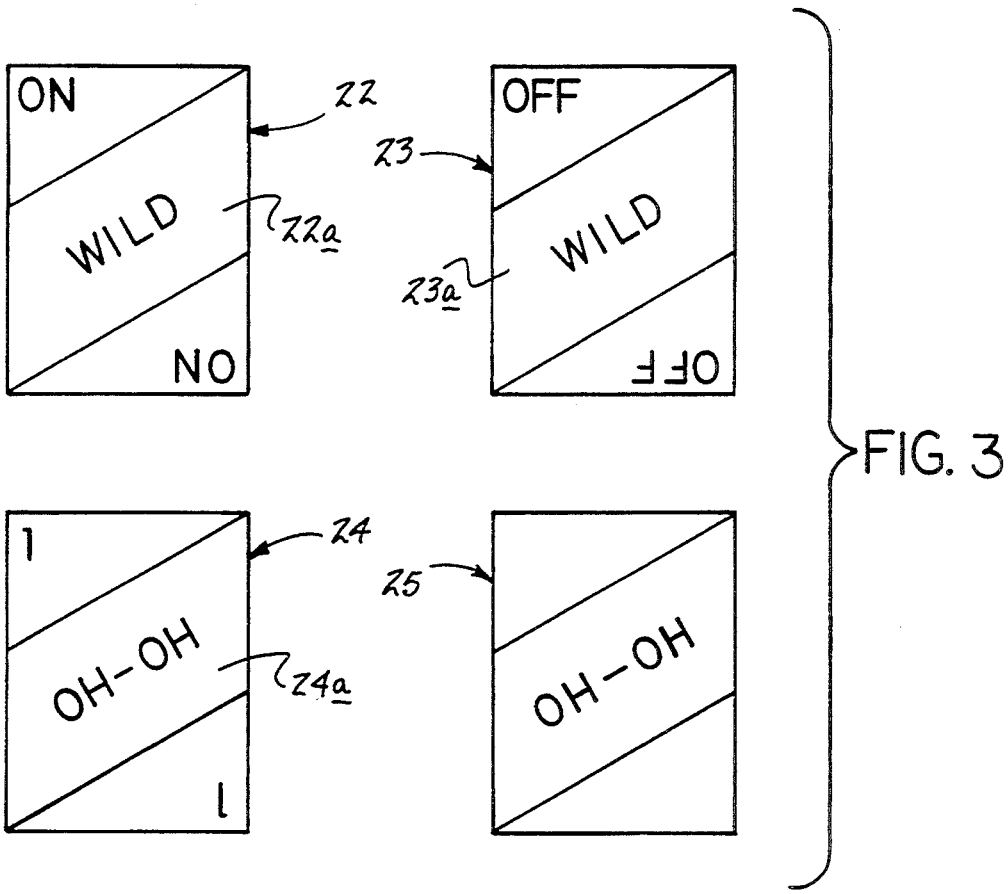
FIG. 3 is an orthographic view of examples of cards employed by the card deck.

With reference now to the drawings, and in particular to FIGS. 1 to 8 thereof, a new and improved board game apparatus embodying the principles and concepts of the present invention and generally designated by the reference numerals 11–44 will be described.

More specifically, the board game apparatus of the instant invention essentially comprises a game board 11 having a board first end 12 spaced from a board second end 13, a board first side 14 spaced from a board second side 15, as well as a board top wall 16. A plurality of token discs 17 are provided, with at least one token disc afforded each of a plurality of game spaces 20. The game spaces are arranged as a rectilinear matrix of intersecting rows and columns of such game spaces, with the game spaces of varying digital enumerations, typically 1–12, but it should be understood that such enumerations are not limited thereto. Each of the corner spaces 21 of the spaces is indicated as a "wild" space to receive a first category of "wild" cards 22 thereon (see FIG. 3). A second category of "wild" cards 23 are provided of an equal number as said first category of cards, wherein a third category of cards are provided indicated as third cards 24. The third cards 24 have third card indicator bottom walls 24*a* to indicate enumerations in coordination with the game spaces 20 and by way of example to include the enumerations 1–12, wherein only the number 1 is indicated and the spaces 2–12 are also employed in a like manner. To this end, at least ninety-six such cards are provided providing a card for each of the game spaces 20, with four of the first category of spaces provided indicated as "on" wild cards as indicated on the first indicator bottom wall 22*a*. The second category of cards 23 having a second indicator bottom wall 23*a* includes an "off" indication. The token discs 17 by way of example are provided in a total of one hundred such tokens, wherein a token first side 18 is of a first coloration and the token second side is of a second coloration, with the second side 19 and the first side 18 thusly contrasting in coloration for opposed sides of an individual or a plurality of players cooperating as opposing groups.

The object of the game is to cover a row of five of the game spaces 20 and to include the spaces 21 in any of three directions to include horizontal, vertical, and diagonal. The first player or group of players to develop two such rows is declared a winner. There are four of the first category of wild cards 22 v. players as players may employ the corner spaces 21 in the development of a row. Initially each player or group of players is provided a predetermined number of cards such as five cards, whereupon a player of the opposing players may position an associated token disc 7 upon a desired space of the spaces 20 and discard that card of the third category of cards that has a companion indication of the enumeraled space, such as a player may position a token upon the space "1" should that player be provided with the enumeration 1 as indicated upon the third indicator bottom wall 24*a*. The player may then draw another card to complete a total of five being held. Should a player forget to draw a card before the next player begins, that player must wait a turn and then upon a subsequent play, draw two cards to again develop the predetermined number of five cards for example being held. The first category of cards 22 is developed, whereupon a player drawing such a card may block an opponent by positioning the moving player's token in opposition to an opponent's row. The exception is that once an opponent has completed a row of the token discs 17, that row may not be tampered with. The second category of wild cards 23 is arranged to remove an opponents token from a developing row. Additional rules to assist in play of the game may be developed as desired by the players, such as the drawing of a card having a designated enumeration, wherein when such enumerations are completely filled upon the game board a player may discard that card and draw another that has potential for use. The FIG. 3 also indicates a card top wall 25, wherein all of the first, second, and third category of cards employs the same card top wall to prevent opponents from understanding the nature of the card being drawn, be it from the first, second, or third category of cards 22, 23, or 24 respectively.

Figure 4:
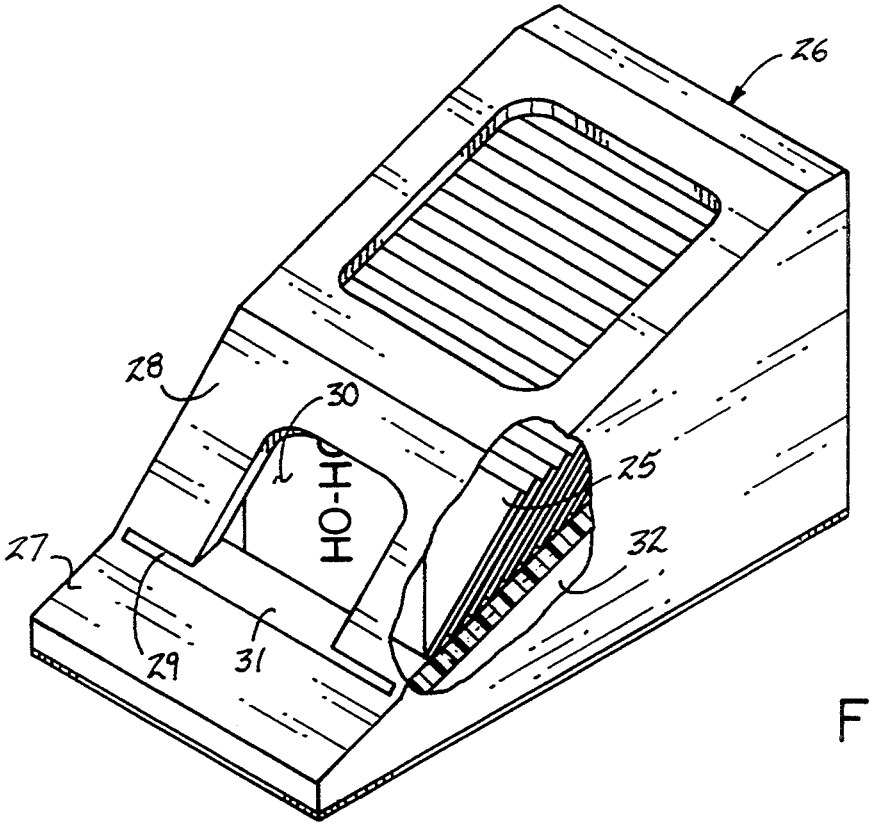
FIG. 4 is an isometric illustration of the card deck mounted within a dispensing housing.
Figure 5:
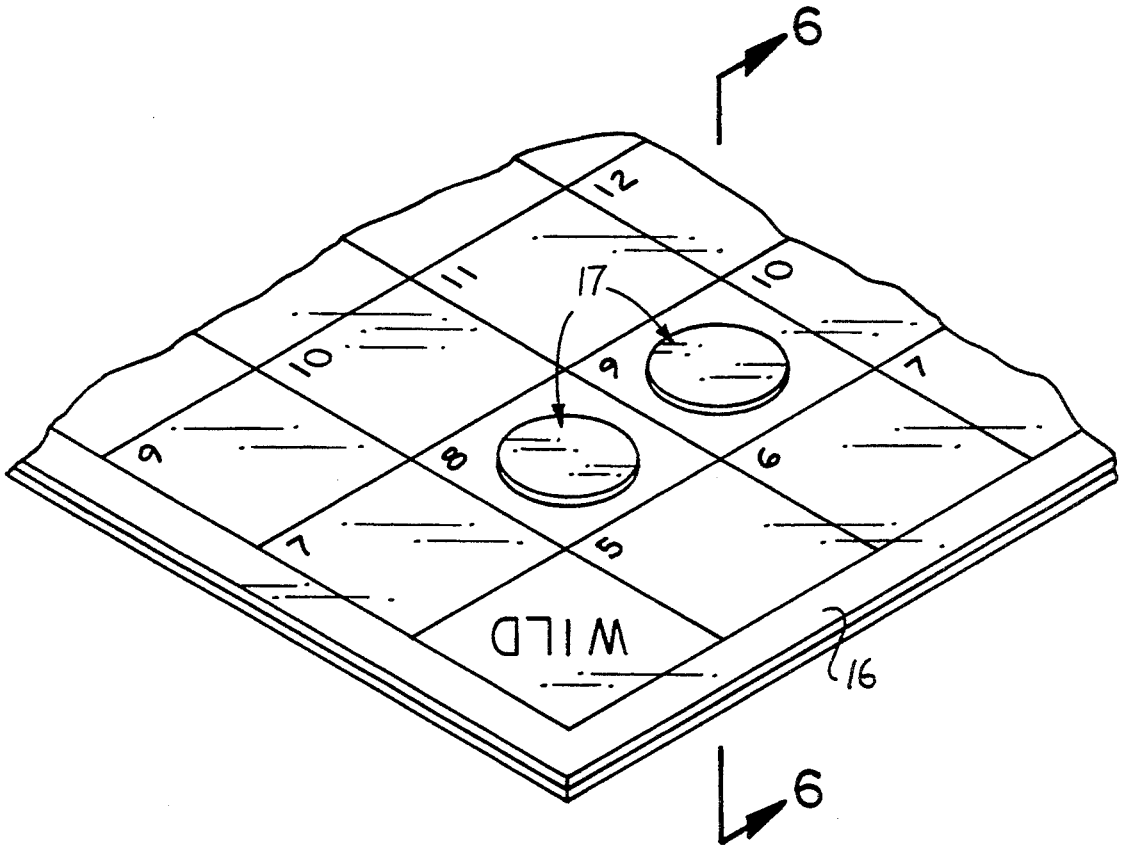
FIG. 5 is an enlarged isometric illustration of the game board.
Figure 6:
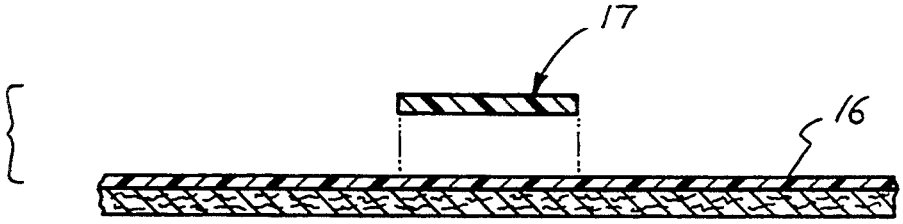
FIG. 6 is an orthographic view, taken along the lines 6—6 of FIG. 5 in the direction indicated by the arrows.

The FIG. 4 indicates the use of dispenser housing 26, wherein the cards or deck of cards may be provided, having a cover including a cover first top wall 27 directed into a cover second top wall 28 at an oblique angulation relative to one another, wherein a dispensing slot 29 is arranged to receive an individual one of the cards therethrough, with the second top wall 28 having a second wall finger access opening 38 intersecting the dispensing slot 29 for ease of grasping and directing a card through the slot 29. The dispenser housing includes a housing floor 31 having floor side panels 32 upon which a cover is received and positioned. The cover is removed for replenishment of cards within the housing 26.

Figure 7:
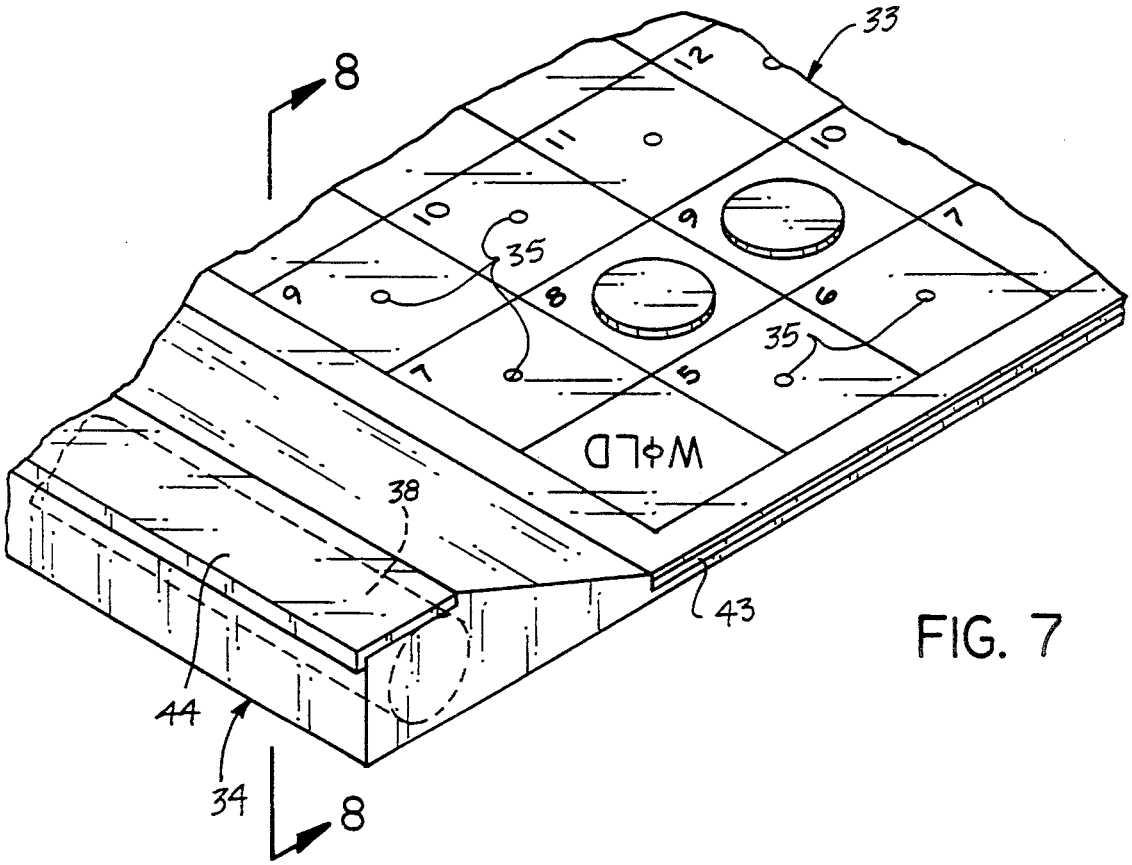
FIG. 7 is an isometric illustration of a modified game board.
Figure 8:
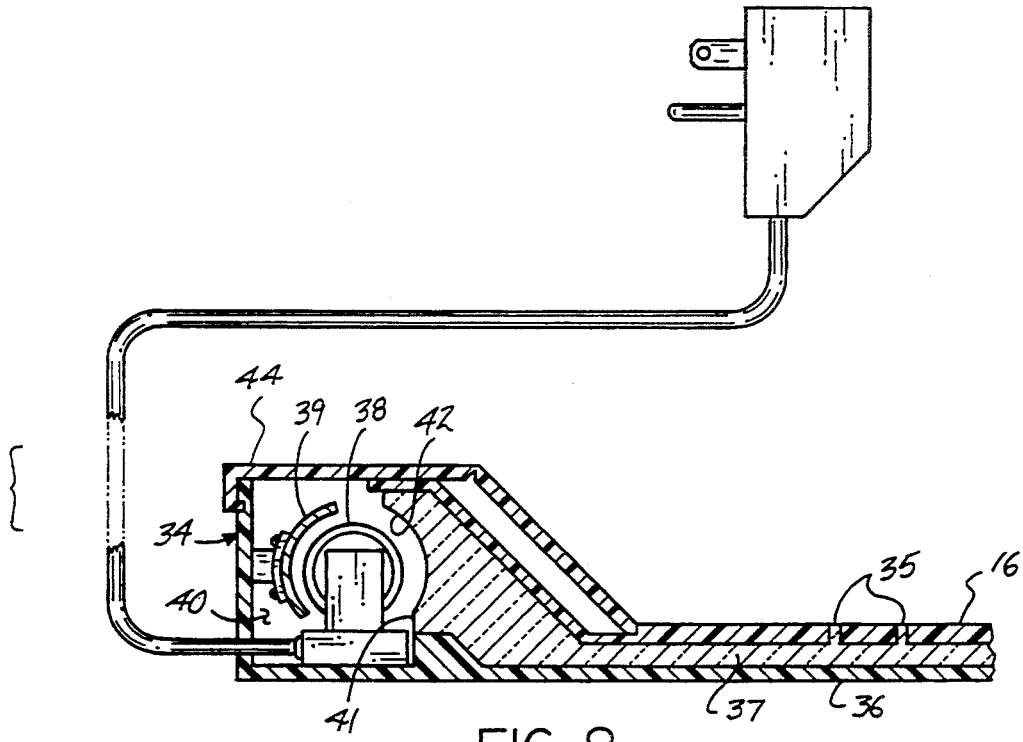
FIG. 8 is an orthographic view, taken along the lines 8—8 of FIG. 7 in the direction indicated by the arrows.

The FIG. 7 indicates the use of a modified game board having an illumination housing 34 integrally mounted along the board second end 13. Each of the spaces 20 and 21 includes a top wall aperture 35 directed therethrough in communication with a transparent lens 37 captured between the game board top wall 16 and the game board bottom wall 36 and projecting exteriorly through the side wall and end wall periphery of the game board. The transparent lens 37 extends into the illumination housing 34 through the second end wall periphery 13 and is arranged coextensive and parallel to an illumination bulb 38 mounted within the illumination housing 34 such that a concave mirror plate 39 is arranged parallel to the illumination bulb 38 on a diametrically opposed side relative to the transparent lens 37. The transparent lens 37 further includes a transparent lens housing end wall 41 having a concave recess 42 coextensive with the transparent lens housing end wall 41 to provide for greater surface area in receiving of illumination from the illumination bulb 38 to be directed through the lens 37 coextensively of the game board structure to provide for ease of viewing of the game board during limited available light, such that as light is directed through the side wall peripheries of the lens projecting through the side wall of the game board, as well as through each of the apertures 35, viewing of the game board is availed in the limited light as noted. The transparent lens periphery 43 accordingly, as illustrated in FIG. 7, is continuous in directing through the side wall periphery of the game board. A housing lid 44 is removably mounted relative to the illumination housing 34 or oriented in a pivotal relationship, as illustrated, for access and maintenance of the illumination bulb 38 within the housing for its replacement and the like. To this end, the mirror 39 is removed providing adequate clearance. The mirror 39 may be mounted by various separable fasteners relative to its support to achieve this purpose. An electrical supply line 45 is provided to provide electrical current to the illumination bulb, in a manner known in the prior art.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, failing within the scope of the inventions.

What is claimed as being new and desired to be protected by LETTERS PATENT of the United States is as follows:

1. A board game apparatus, comprising, a game board, the game board including a game board first end wall, a game board second end wall, a game board first side wall, and a game board second side wall, the game board further including a game board top wall and a game board bottom wall, and the game board top wall including a plurality of rows and columns intersecting one another into a rectilinear matrix of game spaces, wherein the game spaces include corner spaces, each of the game spaces contain numerical indicia of contrasting value relative to adjacent game spaces of said game spaces, and each of the corner spaces are indicated as a "wild" space, and a card deck, wherein the card deck having a first category of cards, a second category of cards, and a third category of cards, and a plurality of token discs, wherein a total of the game spaces are equal to a predetermined number, and said token disc are equal to said predetermined number, and the first category of cards, the second category of cards, and the third category of cards equals to a second predetermined number greater than said predetermined number, wherein the third category of cards indicates an enumeration permitting a player to position a token disc upon one of said game spaces, the first category of cards is arranged permitting positioning of an additional game token on the game spaces, and the second category of cards permits removal of one of said token discs from said game spaces, and the game board includes an illumination housing mounted to the game board coextensive along the second end wall, with a transparent lens directed coextensively through the game board between the game board top wall and the game board bottom wall, with the transparent lens having a transparent lens periphery, and the game board having a game board periphery directed about the first end wall, the second end wall, the first side wall, and the second side wall, wherein the transparent lens periphery projects through the game board periphery, and the transparent lens is directed into the illumination housing from the second end wall, and terminating in a transparent lens housing end wall within the illumination housing, and an illumination bulb mounted within the illumination housing coextensive and parallel to the transparent lens housing end wall, and electrical supply means for directing electrical energy for effecting illumination of the illumination bulb directing illumination through the transparent lens, and each of the game spaces includes an opening in communication with the transparent lens to direct illumination through said opening medially of each of the game spaces.

2. An apparatus as set forth in claim 1 wherein a transparent lens housing end wall includes a concave recess parallel and coextensive with the transparent lens housing end wall in facing relationship to the illumination bulb.

3. An apparatus as set forth in claim 2 including a concave mirror mounted parallel to the illumination bulb coextensive therewith diametrically opposed to the transparent lens housing end wall.

4. An apparatus as set forth in claim 2 including a dispenser housing, the dispenser housing including a dispenser housing floor, the dispenser housing floor having floor side panels and a cover member arranged for reception over the housing floor and side panels, the cover member including a first top wall obliquely intersecting a second top wall, with a dispensing slot directed intermediate the first top wall and the second top wall wherein the dispensing slot includes a second top wall finger access opening in communication with the dispensing slot extending along the second top wall, with the first category of cards, the second category cards, and the third category of cards positioned within the dispenser housing and arranged for dispensing through the dispensing slot.

* * * * *